US008466367B2

(12) United States Patent
Reibke

(10) Patent No.: US 8,466,367 B2
(45) Date of Patent: Jun. 18, 2013

(54) LEAD-THROUGH TERMINAL

(75) Inventor: Heinz Reibke, Bad Salzuflen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 393 days.

(21) Appl. No.: 12/993,982

(22) PCT Filed: May 13, 2009

(86) PCT No.: PCT/EP2009/003394

§ 371 (c)(1),
(2), (4) Date: Nov. 22, 2010

(87) PCT Pub. No.: WO2009/141084

PCT Pub. Date: Nov. 26, 2009

(65) Prior Publication Data

US 2011/0073364 A1 Mar. 31, 2011

(30) Foreign Application Priority Data

May 20, 2008 (DE) ..... 10 2008 024 366

(51) Int. Cl.

| | |
|---|---|
| ***H01B 7/00*** | (2006.01) |
| ***H01R 4/00*** | (2006.01) |
| ***H01R 4/26*** | (2006.01) |
| ***H01R 9/22*** | (2006.01) |
| ***H01R 4/48*** | (2006.01) |

(52) U.S. Cl.
USPC ..... 174/135; 174/79; 174/84 C; 174/88 B; 439/441; 439/712; 439/828

(58) Field of Classification Search
USPC ..... 174/79, 84 C, 88 B, 88 R, 135, 549, 174/551, 555, 559, 560; 439/441, 712, 828, 439/908
See application file for complete search history.

(56) References Cited

U.S. PATENT DOCUMENTS

| | | | | |
|---|---|---|---|---|
| 6,280,233 | B1 * | 8/2001 | Beege et al. | 439/441 |
| 6,336,824 | B1 * | 1/2002 | Sorig | 439/441 |
| 7,083,463 | B2 * | 8/2006 | Steinkemper et al. | 439/441 |

(Continued)

FOREIGN PATENT DOCUMENTS

| | | |
|---|---|---|
| DE | 36 13 681 C1 | 6/1987 |
| DE | 198 01 260 A1 | 7/1999 |

OTHER PUBLICATIONS

International Search Report for International Application No. PCT/EP2009/003394 Dated Aug. 26, 2009.

*Primary Examiner* — Timothy Thompson
*Assistant Examiner* — Sherman Ng
(74) *Attorney, Agent, or Firm* — Roberts Mlotkowski Safran & Cole, P.C.; David S. Safran

(57) ABSTRACT

A lead-through terminal for leading an electric line through a wall, having a first terminal housing and a second terminal housing, at least one first conductor connection member in the first terminal housing and at least one conductor connection member in the second terminal housing, and a bus bar electrically connecting the first conductor connection member to the second conductor connection member when the first terminal housing and the second terminal housing are connected together. The two conductor connection members each have a leg spring and a metal part, the leg springs each having a clamping leg and a contact leg, the clamping legs and corresponding metal parts each form a spring-force clamp connection for connection of an electrical conductor. The bus bar is arranged in the first terminal housing and electrically conductively connected at a first end thereof to the metal part of the first conductor connection member.

12 Claims, 5 Drawing Sheets

U.S. PATENT DOCUMENTS

2006/0063420 A1* 3/2006 Reibke et al. ..... 439/441
2006/0128206 A1* 6/2006 Oesterhaus ..... 439/441
2007/0099479 A1* 5/2007 Holterhoff et al. ..... 439/441
2007/0099480 A1* 5/2007 Fabian et al. ..... 439/441

* cited by examiner

LEAD-THROUGH TERMINAL

BACKGROUND OF THE INVENTION

1. Field of the Invention

The invention relates to a lead-through terminal for routing an electrical line through a wall, with a first terminal housing and a second terminal housing, where the first terminal housing can be routed from one side and the second terminal housing from the other side to an opening formed in the wall and can be connected to one another through the opening, holding the wall between themselves, with at least one first conductor connecting body which is located in the first terminal housing and at least one second conductor connecting body which is located in the second terminal housing, and with a busbar via which the first conductor connecting body is connected to the second conductor connecting body in an electrically conductive manner, when the first terminal housing and the second terminal housing are connected to one another.

2. Description of Related Art

In industrial connection technology it is often necessary for currents to be routed through a wall, for example, the housing wall of an industrial electrical device, for example, a power electronics device. To do this, lead-through terminals are used which are in part also called wall lead-through terminals and which have, fundamentally, been known for decades. The lead-through terminals should have an equally reliable and convenient connection of the external conductor to the corresponding internal conductor of the electrical device. The known lead-through terminals which have an insulated housing protected against touching are designed for arrangement and attachment in openings and cutouts of housing walls such that they can be mounted in the openings and cutouts using different techniques.

Fundamentally, two types of lead-through terminals can be distinguished. One-piece lead-through terminals which are pushed into an accordingly dimensioned opening in the wall up to a stop and which are fixed in the opening by means of separate catch elements or those made on the terminal housing, and two-piece lead-through terminals whose two terminal halves can be connected to one another by mating, the two terminal halves being located in the state mounted to one another—at least for their largest part—on different sides of the wall and holding the wall between themselves.

A lead-through terminal of the two-piece type which underlies this invention is disclosed in German Patent DE 36 13 681 C1. This lead-through terminal, which has been produced and marketed by the assignee of the present application for almost 20 years, has a screw connecting body both as the outer conductor connecting body and the inner conductor connecting body. In installation, the busbar which is permanently connected to the screw connecting body of one terminal half is inserted into the opened connection space of the screw connecting body of the other terminal half, so that for electrical connection of the two terminal halves or the two screw connecting bodies neither an additional contact nor an additional mounting step is necessary. Even if the known lead-through terminal has proven itself very effective in practice, especially as a heavy current lead-through terminal, the connection of the conductors to the two screw connecting bodies is relatively time-consuming as a result of the connection principle of the screw terminal.

SUMMARY OF THE INVENTION

Therefore, the object of this invention is to provide a lead-through terminal of the initially described type which enables easier connection of the conductors to the conductor connecting body while maintaining ease of installation.

This object is achieved in the initially described lead-through terminal in that both the first conductor connecting body and also the second conductor connecting body each have a leg spring and a metal part, each leg spring has a clamping leg and a contact leg, and the clamping leg and the metal part form a spring force clamping connection for a respective electrical conductor to be connected. The electrical connection between the two conductor connecting bodies is achieved by the busbar being located in the first terminal housing and with one end thereof being connected to the metal part of the first conductor connecting body in an electrically conductive manner and the other end of the busbar making contact with the contact leg of the second conductor connecting body when the first terminal housing and the second terminal housing are connected to one another.

The lead-through terminal in accordance with the invention thus differs, first of all, from the lead-through terminal known from the prior art in that a screw terminal technique has not been implemented for the two conductor connecting bodies, but instead a leg spring connecting technique is utilized. A conductor which has been stripped, rigid or provided with a wire end ferrule and which is to be connected can thus be easily connected to the lead-through terminal by the conductor being inserted into the conductor connecting body through a conductor insertion opening formed in the terminal housing, the conductor to be connected being pressed by the end of the clamping leg of the leg spring against a region of the metal part, and in this way, electrical contact being made. The rigid conductor or one which is provided with a wire end ferrule can thus be electrically connected directly to the lead-through terminal without a tool; the relatively time-consuming tightening of the clamping screw in the screw terminal is eliminated.

In the lead-through terminal known from German Patent DE 36 13 681 C1 with screw connecting bodies, when the two terminal halves are connected, the busbar connected to a screw connecting body is inserted into the opened connecting space of the screw terminal of the other terminal half, when the clamping screw of the second screw terminal is tightened the electrical conductor to be connected being pulled against the busbar which has been inserted in the connecting space. In order to automatically achieve the electrical connection between the two conductor connecting bodies via the busbar in the lead-through terminal in accordance with the present invention, when the two terminal housings are being connected, the lead-through terminal in accordance with the invention is made such that the end of the busbar which is not connected to the metal part of the first conductor connecting body in an electrically conductive manner makes contact with the contact leg of the clamping spring of the second conductor connecting body, when the first terminal housing and the second terminal housing are connected to one another. The contact leg with the metal part thus forms a spring force clamping connection for the second end of the busbar.

According to an advantageous configuration of the lead-through terminal in accordance with the invention, the free end of the contact leg of the leg spring of the second conductor connecting body is bent such that it is directed away from the busbar so that the free end of the contact leg forms an insertion aid for the second end of the busbar. In this way, when the two terminal housings are connected, the second end of the busbar is inserted more easily by the angled end of the contact leg into the spring force clamping connection between the contact leg and the corresponding region of the metal part.

There are different possibilities with respect to the specific configuration of the leg springs and the metal parts of the two conductor connecting bodies. According to one preferred version, the metal part has two contact walls opposite one another and a back which connects the contact walls, the first contact wall with the clamping leg of the leg spring forming the spring force clamping connection for the conductor to be connected and the second contact wall with the contact leg of the leg spring forming a spring force clamping connection for one end of the busbar. A metal part which is made in this way can be used both for the first conductor connecting body and also for the second conductor connecting body.

If this metal part is used in the second conductor connecting body, the second contact wall with the contact leg of the leg spring forms the spring force clamping connection of the second end of the busbar which is located in the first terminal housing and with its first end is connected to the metal part of the first conductor connecting body in an electrically conductive manner. In this configuration of the second conductor connecting body, if the free end of the contact leg of the leg spring is bent, the free end of the contact leg together with the second contact wall of the metal part form an insertion funnel for the second end of the busbar. When the two terminal housings are connected, the second end of the busbar is thus "trapped" by the insertion funnel so that the end of the busbar can be easily inserted into the spring force clamping connection between the contact leg of the leg spring and the second contact wall.

As was stated above, the metal part of the first conductor connecting body can also have two opposite contact walls and a back which connects the contact walls. According to another preferred configuration, the metal part of the first conductor connecting body is, however, made as a flat busbar in which a conductor through opening with a perforated collar which extends into the conductor through opening is made. The leg spring is arranged such that the end of the clamping leg of the leg spring dips into the conductor through opening so that the clamping leg of the leg spring with a corresponding inside wall of the perforated collar forms the spring force clamping connection for the conductor which is to be connected. This metal part, which is made as a flat busbar with a conductor through opening and a perforated collar, can be produced especially easily and in a material-saving manner. Moreover, this metal part can also have very small dimensions so that a lead-through terminal that is altogether very compact can be implemented.

In one advantageous configuration of a metal part made from a flat busbar, the leg spring is fastened to the metal part by the end of the contact leg of the leg spring being inserted into the conductor through opening so that the leg spring is held in the conductor through opening. Alternatively, then, another opening can be made in the busbar that is spaced apart from the conductor through opening and into which the end of the contact leg of the leg spring is inserted and fastened.

Fixing and holding the leg spring in the conductor through opening can be further improved in that the contact leg of the leg spring has laterally projecting contact shoulders which, in the mounted state of the leg spring and of the metal part, rest on the edge of the conductor through opening. In this way, the metal part and the leg spring can be easily pre-mounted so that they can be more easily used as a structural unit for further mounting in the terminal housing. Additional fixing of the leg spring can, of course, also be ensured by correspondingly made retainer projections in the terminal housing.

Fundamentally, the busbar can be made both as a separate component and also can be connected integrally to the metal part of the first conductor connecting body. Making the busbar in one piece with the metal part can be done especially easily when the metal part of the first conductor connecting body is made as a flat busbar. Conversely, if the busbar is made as a separate component, the connection of the busbar to the metal part of the first conductor connecting body is implemented, preferably, by a spring force clamping connection between the first end of the busbar and the clamping leg or the contact leg of the leg spring. This detachable connection of the busbar to the metal part of the first conductor connecting body can then be easily implemented when the metal part of the first conductor connecting body also has two opposite contact walls and a back which connects the contact walls. Then, the second contact wall with the contact leg forms the spring force clamping connection for the first end of the busbar.

Mechanical attachment between the two terminal housings is ensured according to one preferred configuration in that the first terminal housing and the second terminal housing have catch elements which are assigned to one another, especially rows of teeth which can be engaged with one another, so that the first terminal housing and the second terminal housing can be latched to one another via catch elements, holding the housing wall between themselves.

In particular there is now a host of possibilities for embodying and developing the lead-through terminal in accordance with the invention. For this purpose, reference is made to the following description of a preferred exemplary embodiment in conjunction with the accompanying drawings.

DETAILED DESCRIPTION OF THE INVENTION

Figure 1:
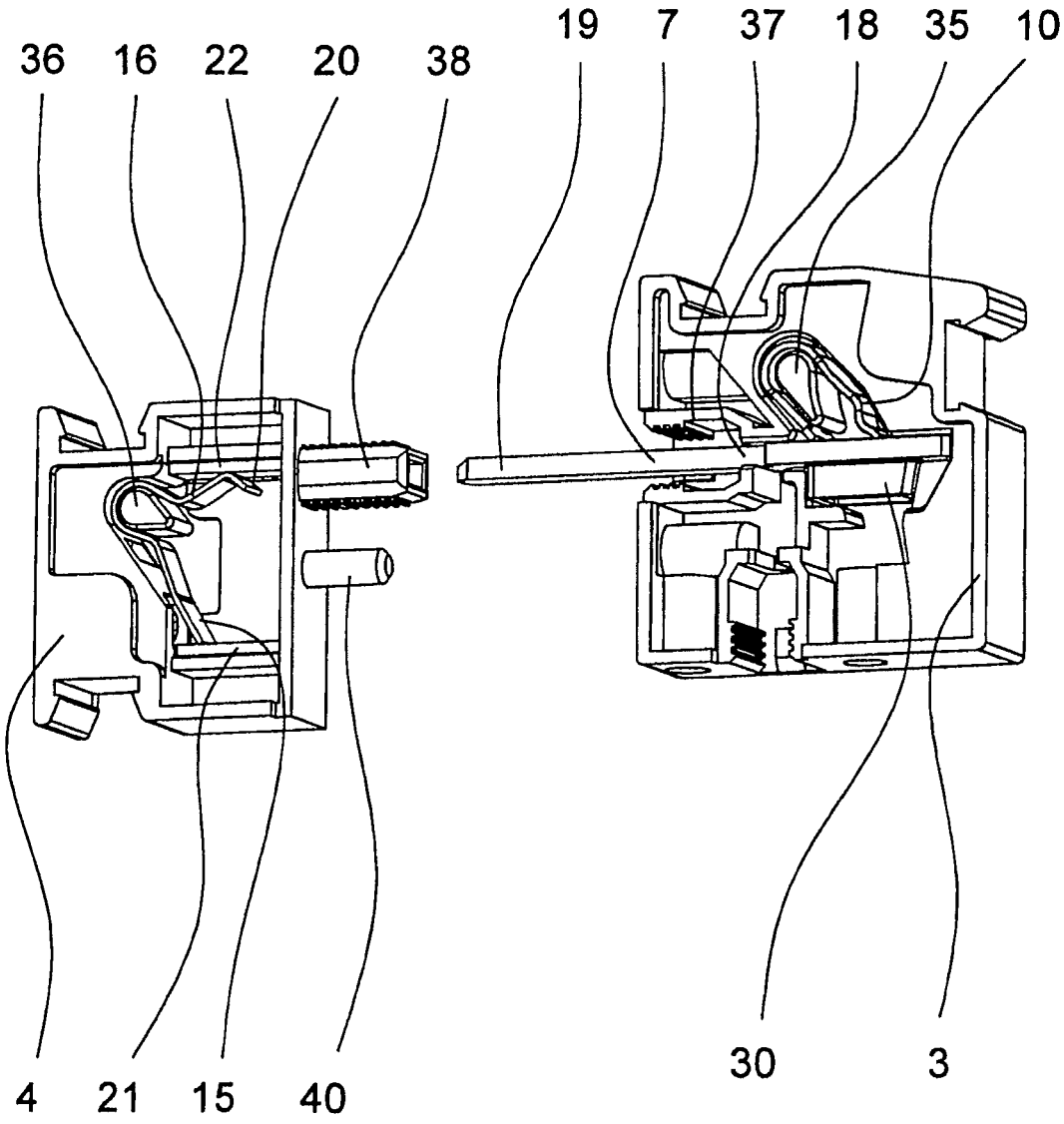
FIG. 1 shows the two terminal halves of a lead-through terminal in accordance with the invention, in the not yet interconnected state.
Figure 2:
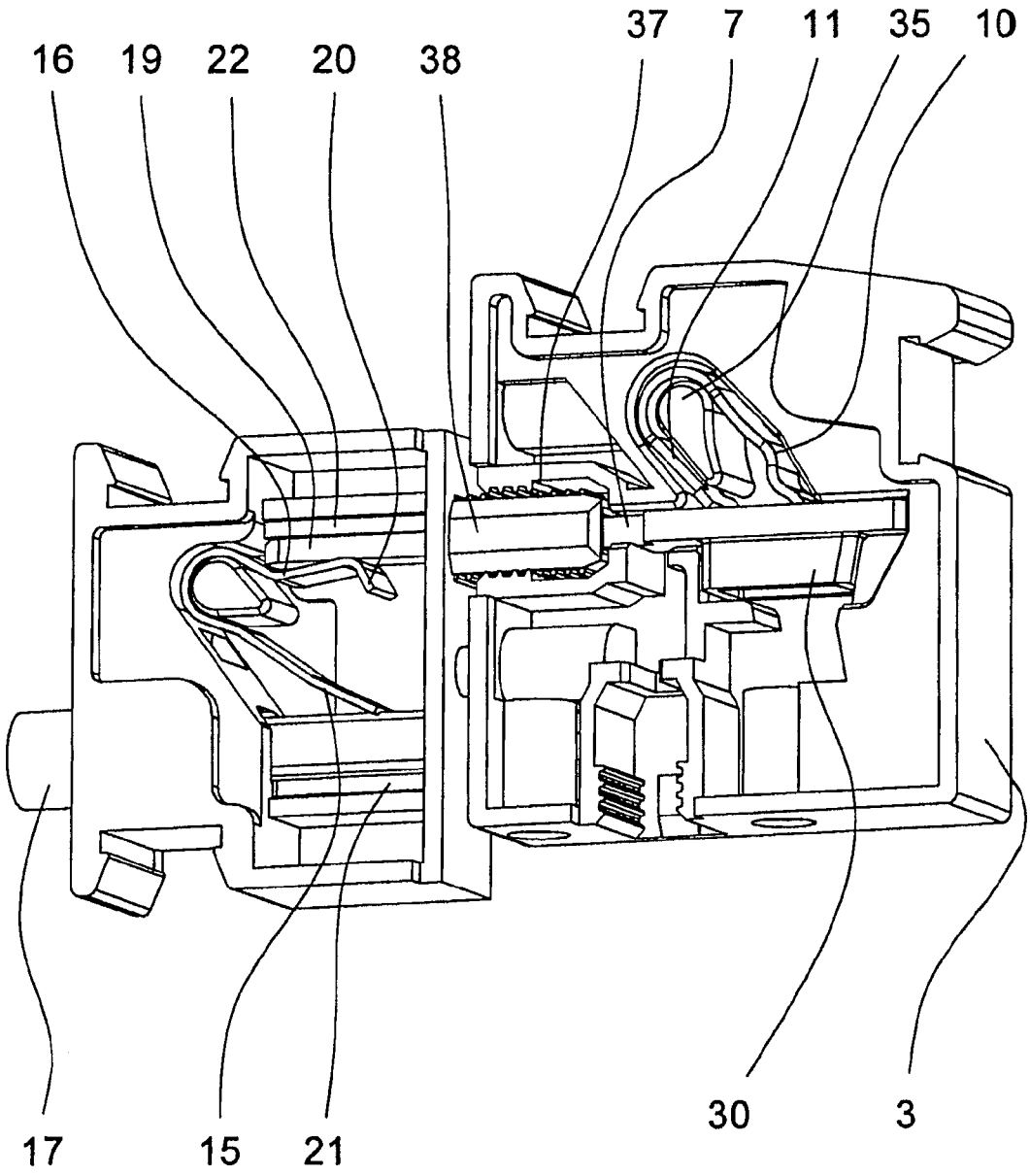
FIG. 2 shows the lead-through terminal of FIG. 1 in the mounted state.
Figure 3:
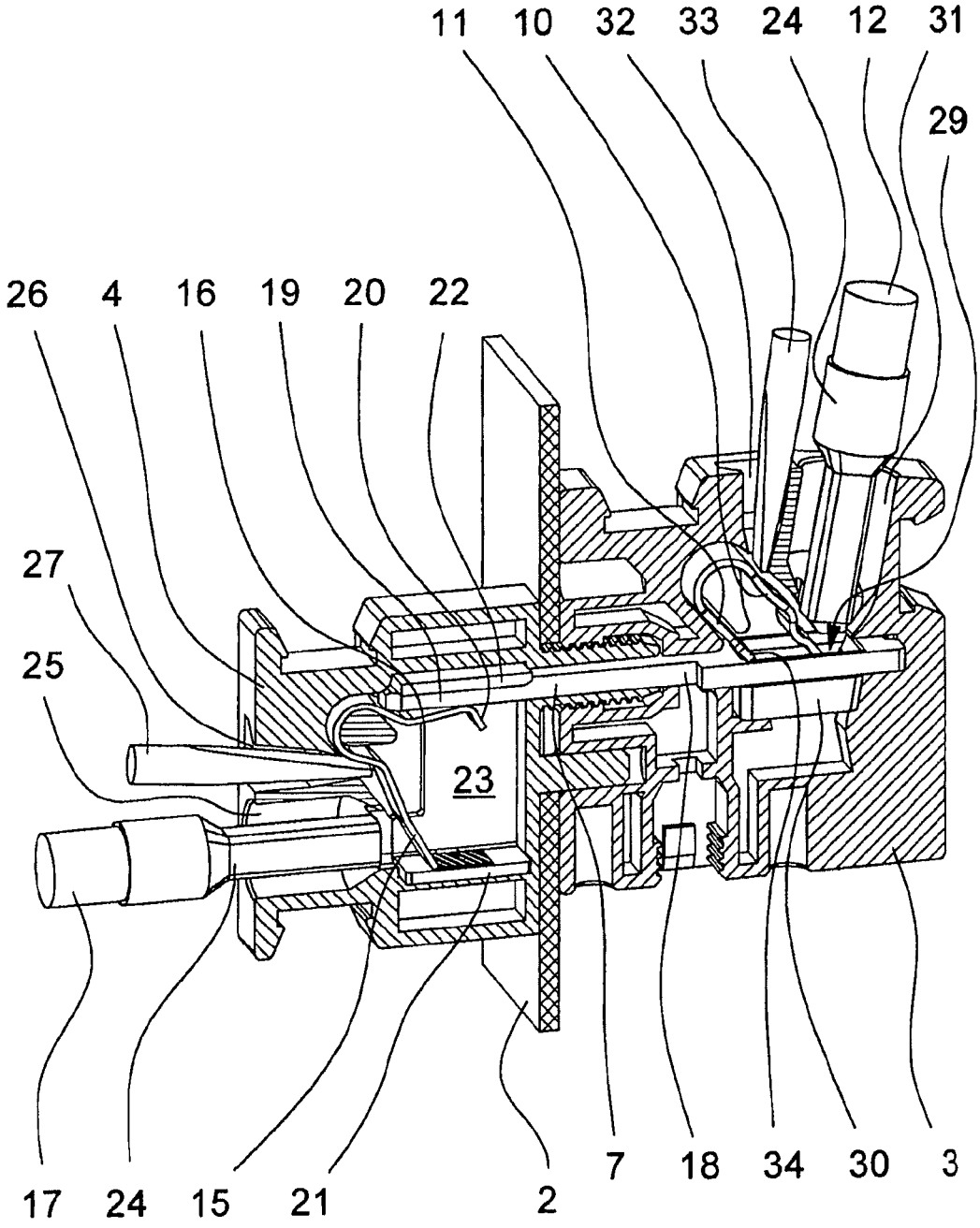
FIG. 3 shows the lead-through terminal of FIG. 2 in a longitudinal section.

FIGS. 1 to 3 show an exemplary embodiment of a lead-through terminal 1 in accordance with the invention for routing an electrical conductor through a wall 2 which is only suggested in FIG. 3, which wall can be, for example, the wall of an electrical device. The lead-through terminal 1 is of a two-piece type so that the lead-through terminal 1 has a first terminal housing 3 and a second terminal housing 4, the first terminal housing 3 being routed through the wall 2 from one side, for example, the outside of the device, and the second terminal housing 4 being routed through the wall from the other side, for example, the inside of the device, so that the two terminal housings 3, 4, in the interlatched state, are located on the two opposing sides of the wall 2 holding the wall 2 between themselves.

Figure 4:
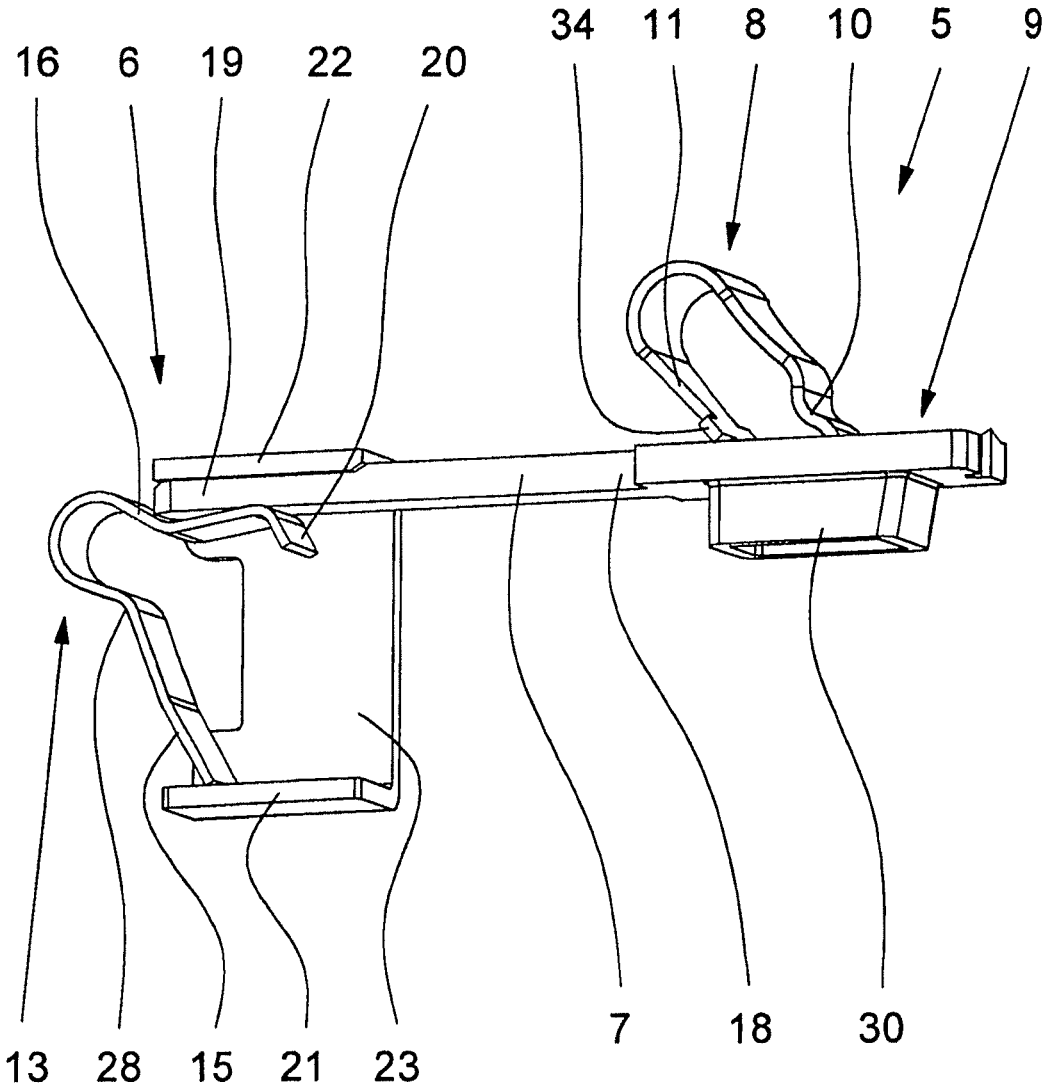
FIG. 4 shows the two conductor connecting bodies of the lead-through terminal in accordance with the invention.

Within the first terminal housing 3, there is a first conductor connecting body 5 and there is a second conductor connecting body 6 within the second terminal housing 4 (FIG. 4). The first conductor connecting body 5, due to its position outside the device, can also be called the outer conductor connecting body and the second conductor connecting body 6, due to its position within the device, can be called the inner conductor connecting body. For electrical connection of the two conductor connecting bodies 5, 6, in the first terminal housing 3, there is a busbar 7 connected to the first conductor connecting body 5 in an electrically conductive manner.

As is especially apparent in FIG. 4, the first conductor connecting body 5 has a leg spring 8 and a metal part 9, the leg spring 8 being made essentially U-shaped and having a clamping leg 10 and a contact leg 11. The leg spring 8 and the metal part 9 are arranged relative to one another such that the clamping leg 10 and the metal part 9 form a spring force clamping connection for a first electrical conductor 12 which is shown in FIG. 3. The second conductor connecting body 6 also has a leg spring 13 and a metal part 14, the leg spring 13 of the second conductor connecting body 6 also having a clamping leg 15 and a contact leg 16, the clamping leg 15 with the metal part 14 forming a spring force clamping connection for a second electrical conductor 17 which is shown in FIGS. 2 and 3.

The busbar 7, which is designed for electrical connection of the two conductor connecting bodies 5, 6, is connected by its first end 18 to the metal part 9 of the first conductor connecting body 5 in an electrically conductive manner by the busbar 7 being formed in one piece with the metal part 9. If the two terminal housings 3, 4 are latched to one another, the second end 19 of the busbar 7 makes contact with the contact leg 16 of the second conductor connecting body 6, as is apparent from FIGS. 2 to 4. The contact leg 16 with the metal part 14 forms a spring force clamping connection for the second end 19 of the busbar 7. So that the second end 19 of the busbar 7 can be easily inserted into the closed spring force clamping terminal from the rear side, i.e., opposite the insertion direction of the conductor 17 which is to be connected when the two terminal housings 3, 4 are mated, the free end 20 of the contact leg 16 being bent such that it is directed away from the busbar 7. The free end 20 thus forms an insertion aid for the second end 19 of the busbar 7.

Figure 5:
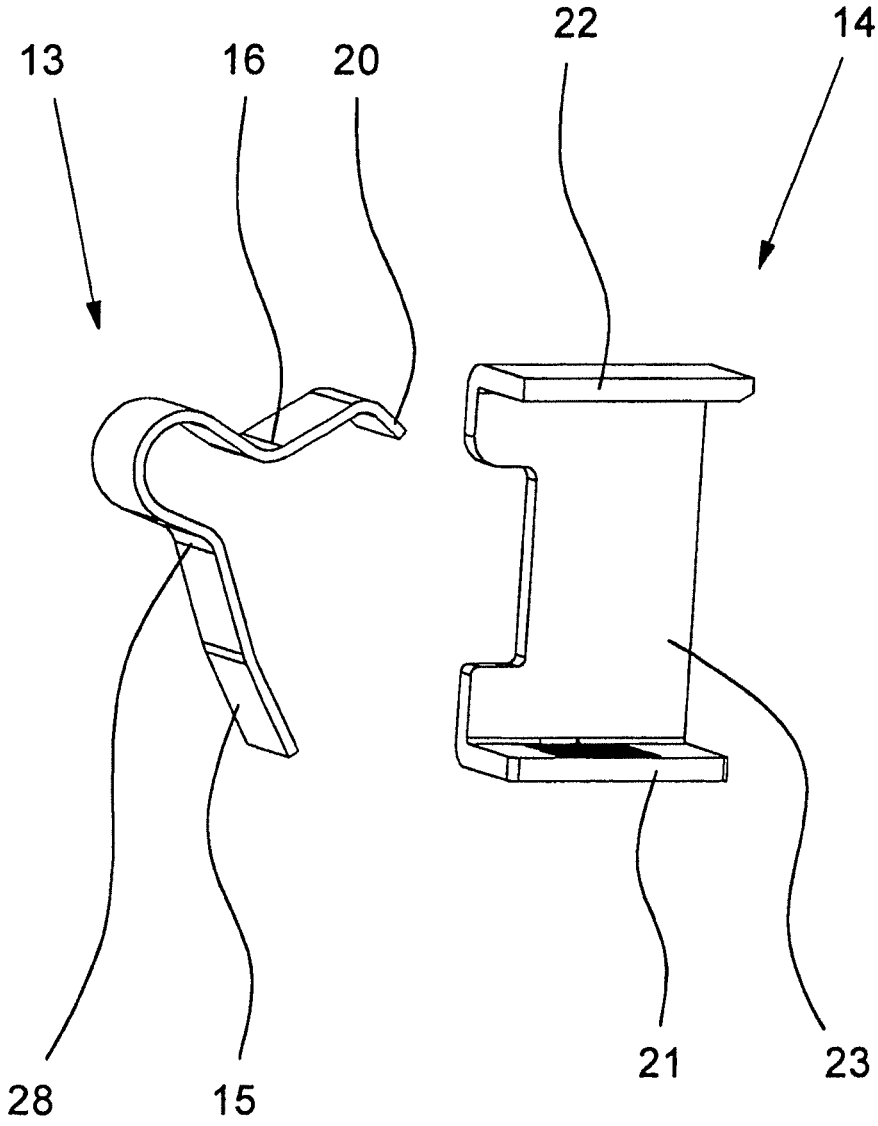
FIG. 5 shows the leg springs and the metal part of the second conductor connecting body in the unmounted state.

In the exemplary embodiment of a lead-through terminal 1 in accordance with the invention which is shown in the figures, the metal part 14 of the second conductor connecting body 6 has two opposite contact walls 21, 22 which are connected to one another via a back 23, i.e., is C-shaped as most clearly shown in FIGS. 4 & 5. The leg spring 13 and the metal part 14 are arranged relative to one another such that the clamping leg 15 with the first contact wall 21 forms the spring force clamping connection for the conductor 17 which is to be connected and the contact leg 16 with the second contact wall 22 forms a spring force clamping connection for the second end 19 of the busbar 7.

To insert a conductor 17 which is provided with a wire end ferrule 24 into the clamping site, a conductor insertion opening 25 is made in the terminal housing 4. In order to facilitate insertion of the electrical conductor 17 into the clamping site and in order to remove a connected electrical conductor 17, if necessary, from the clamping site again, an actuation opening 26 for insertion of an actuating tool 27, for example, the tip of a screwdriver, is made in the terminal housing 4. Using the actuating tool 27, it is then possible to press on the clamping leg 15 of the leg spring 8, as a result of which the leg spring 8 opens so that an electrical conductor 17 can be more easily inserted or pulled out of the clamping site. On the clamping leg 15, a kink 28 is formed which is used as an attack point for the tip of the actuating tool 27 so that the actuating tool 27 is prevented from sliding along the clamping leg 15.

In contrast to the metal part 14 of the second conductor connecting body 6, the metal part 9 of the first conductor connecting body 5 is made as a flat busbar in which a conductor through opening 29 (FIG. 3) with a perforated collar 30 is made which extends in the conductor through direction. The end of the clamping leg dips into the conductor through opening 29 such that the clamping leg 10 with the corresponding inside wall of the perforated collar 30 forms the spring force clamping connection for the electrical conductor 12 which is to be connected. In the same manner as the second terminal housing 4, the first terminal housing 3 also has a conductor through opening 31 for the conductor 12 to be connected and an actuating opening 32 for an actuating tool 33. Here, using an actuating tool 33 which is inserted into the actuating opening 32 the clamping leg 10 of the leg spring 8 can be deflected so that an electrical conductor 12 can be more easily inserted into the conductor insertion opening 29 or a connected conductor 12 can be pulled out of the terminal housing 3.

The leg spring 8 is attached to the metal part 9 by the end of the contact leg 11 likewise being inserted into the conductor through opening 29. Moreover, the contact leg 11 has laterally projecting contact shoulders 34 which, in the mounted state, rest on the edge of the conductor through opening 29. In addition, a retaining pin 35 in made in the terminal housing 3 for positioning and holding the leg spring 8 and a retaining pin 36 in made in the terminal housing 4 for positioning and holding of the leg spring 13.

The mechanical connection between the two terminal housings 3, 4 takes place using catch elements 37, 38 which are provided with rows of teeth which can be engaged with one another in the illustrated preferred exemplary embodiment. With consideration of the inherent elasticity of the plastic terminal housings 3, 4, the rows of teeth can be caused to engage one another by simply pushing the two terminal housings 3, 4 together so that the two terminal housings 3, 4 are reliably and permanently latched. As is apparent from FIG. 2, the busbar 7 is surrounded in a completely insulating manner by the box-shaped execution of the catch element 38 which is molded on the second terminal housing 4 and which is encompassed by the catch element 37 in the latched position in the manner of tongs, so that the insulation of the busbar 7 in the region of the opening of the wall 2 is also very good.

In order to ensure a certain orientation of the two terminal housings 3, 4 relative to the wall 2, the first terminal housing 3 and the second terminal housing 4 have anti-rotation elements 39, 40 which are assigned to one another, in the exemplary embodiment shown here a hole being provided in the first terminal housing 3 and a pin being made on the second terminal housing 4. In the exemplary embodiment shown in the figures, the connection direction of the first conductor 12 is essentially perpendicular to the connection direction of the second conductor 17. Of course, the connection direction of the two conductors 12, 17 can also be parallel or opposite one another, and the connection direction of the two conductors 12, 17 can run both perpendicular and also parallel to the surface normal of the wall 2.

What is claimed is:

1. Lead-through terminal for routing an electrical line through a wall, comprising:

a first terminal housing adapted to be routed through an opening formed in a wall from a first side thereof, a second terminal housing adapted to be routed through the opening formed in the wall from a second side thereof, and being connectable to first terminal housing through the opening with the wall held between the housings, at least one first conductor connecting body which is located in the first terminal housing at least one second conductor connecting body which is located in the second terminal housing, and a busbar via which the first conductor connecting body is connectable to the second conductor connecting body in an electrically conductive manner, when the first terminal housing and the second terminal housing are connected to one another, wherein the first conductor connecting body has a first leg spring and a first metal part, the first leg spring having a clamping leg and a contact leg, the clamping leg and the first metal part forming a first spring force clamping connection for a first electrical conductor to be connected, wherein the second conductor connecting body has a second leg spring and a second metal part, the second leg spring having a clamping leg and a contact leg, and the clamping leg of second leg spring and the second metal part forming a second spring force clamping connection for a second electrical conductor to be connected, wherein the busbar is located in the first terminal housing with one end connected to the metal part of the first conductor connecting body in an electrically conductive manner, and wherein a second end of the busbar makes is adapted to make contact with the contact leg of the second conductor connecting body when the first terminal housing and the second terminal housing are connected to one another.

2. Lead-through terminal as claimed in claim 1, wherein a free end of the contact leg of the second leg spring of the second conductor connecting body bent away from the busbar so that the free end of the contact leg forms an insertion aid for the second end of the busbar.

3. Lead-through terminal as claimed in claim 1, wherein the metal part of the second conductor connecting body is C-shaped with opposite first and second contact walls and a back which connects the contact walls, the first contact wall forms the second spring force clamping connection together with the clamping leg of the second leg spring and the second contact wall forms a spring force clamping connector for the second end of the busbar together with the contact leg of the second leg spring.

4. Lead-through terminal as claimed in claim 3, wherein a free end of the contact leg of the leg spring of the second conductor connecting body together with the second contact wall of the metal part of the second conductor connecting body form an insertion funnel for the second end of the busbar.

5. Lead-through terminal as claimed in claim 1, wherein the metal part of the first conductor connecting body is a flat busbar in which a conductor through opening with a perforated collar extends, wherein the end of the clamping leg of the first leg spring of the first conductor connecting body extends into the conductor through opening so that the clamping leg of the first leg spring forms the spring force clamping connection for the first electrical conductor with an inside wall of the perforated collar.

6. Lead-through terminal as claimed in claim 5, wherein the first leg spring is held in the conductor through opening.

7. Lead-through terminal as claimed in claim 6, wherein the contact leg of the first leg spring of the first conductor connecting body has laterally projecting contact shoulders which rest on an edge of the conductor through opening.

8. Lead-through terminal as claimed in claim 1, wherein the busbar is permanently connected to the metal part of the first conductor connecting body.

9. Lead-through terminal as claimed in claim 1, wherein the busbar is a detachably connected to the metal part of the first conductor connecting body by a spring force clamping connection between a first end of the busbar and one of the legs of the first leg spring.

10. Lead-through terminal as claimed in claim 1, wherein the first terminal housing and the second terminal housing have catch elements which are engageable with one another for latching the first terminal housing and the second terminal housing to one another.

11. Lead-through terminal as claimed in claim 10, wherein the catch elements comprise male and female elements having rows of teeth.

12. Lead-through terminal as claimed in claim 1, wherein the first terminal housing and the second terminal housing have anti-rotation elements which are assigned to one another.

* * * * *